US006644475B2

(12) United States Patent
Wilson, II et al.

(10) Patent No.: US 6,644,475 B2
(45) Date of Patent: Nov. 11, 2003

(54) MULTI-PURPOSE BAG

(75) Inventors: Ronald L. Wilson, II, Ellicott City, MD (US); Alan Tipp, Baltimore, MD (US); Brian E. Le Gette, Baltimore, MD (US); Matthew Eliot Isom, Baltimore, MD (US)

(73) Assignee: Gray Matter Holdings LLC, Baltimore, MD (US)

( * ) Notice: Subject to any disclaimer, the term of this patent is extended or adjusted under 35 U.S.C. 154(b) by 7 days.

(21) Appl. No.: 10/029,421

(22) Filed: Dec. 21, 2001

(65) Prior Publication Data

US 2003/0116465 A1 Jun. 26, 2003

(51) Int. Cl.[7] ..... B65D 81/02
(52) U.S. Cl. ..... 206/522; 5/644; 383/3
(58) Field of Search ..... 206/216, 217, 206/549, 522; 5/636, 644; 150/106, 197, 112; 190/109, 115; 383/3, 40, 72, 74–76

(56) References Cited

U.S. PATENT DOCUMENTS

| | | | | |
|---|---|---|---|---|
| 3,902,640 A | | 9/1975 | Gieben | |
| 4,116,310 A | | 9/1978 | Shields | |
| 4,280,643 A | | 7/1981 | Cordova et al. | |
| D262,072 S | | 12/1981 | Pfeiffer | |
| 4,506,769 A | | 3/1985 | Franco et al. | |
| 4,569,082 A | * | 2/1986 | Ainsworth et al. | 206/522 |
| 4,573,202 A | * | 2/1986 | Lee | 206/522 |
| 4,793,123 A | * | 12/1988 | Pharo | 206/522 |
| 4,801,213 A | * | 1/1989 | Frey et al. | 206/522 |
| 5,060,833 A | | 10/1991 | Edison et al. | |
| 5,114,059 A | | 5/1992 | Thatcher | |
| 5,135,132 A | | 8/1992 | Potochnik | |
| 5,238,305 A | * | 8/1993 | Feller | 383/75 |
| 5,263,618 A | | 11/1993 | Talavera | |
| D363,599 S | | 10/1995 | Gaffin | |
| 5,570,824 A | | 11/1996 | Lyon et al. | |
| 5,732,849 A | | 3/1998 | Brooks | |
| 5,875,890 A | * | 3/1999 | Di Bernardini | 206/522 |
| 5,890,809 A | | 4/1999 | Nelson | |
| 5,927,581 A | | 7/1999 | Reddy et al. | |
| 6,052,939 A | | 4/2000 | McClain et al. | |
| D425,698 S | | 5/2000 | Paul et al. | |
| 6,082,896 A | | 7/2000 | Pulli | |
| 6,105,844 A | | 8/2000 | Walters et al. | |
| 6,193,201 B1 | | 2/2001 | Babcock | |
| 6,241,135 B1 | | 6/2001 | Thatcher | |
| D446,013 S | | 8/2001 | Pironti | |
| D447,336 S | | 9/2001 | Bergkvist et al. | |
| 6,296,165 B1 | | 10/2001 | Mears | |
| 6,519,796 B2 | * | 2/2003 | Sloot | 5/636 |

OTHER PUBLICATIONS

Easton Sports, Easton Baseball, Bag Neo Classic Tote, SKU #: A 163 846, Jun. 7, 2002.
Easton Sports, Easton Baseball, Bag Ultra Tote, SKU #A 163 835, Jun. 7, 2002.

* cited by examiner

*Primary Examiner*—Luan K. Bui
(74) *Attorney, Agent, or Firm*—Whiteford, Taylor & Preston LLP; Gregory M. Stone; Jeffrey C. Maynard

(57) ABSTRACT

A multi-purpose bag is disclosed which includes an inflatable member integrated therewith such that the bag may be used as both a carrying device and a cushioning device. The bag is provided a pocket on at least one side thereof which pocket is configured to removably hold the inflatable member. The inflatable member is useful as a pillow both when held inside of the pocket and when attached to a chair or other device outside of the pocket. A receptacle configured to hold a beverage container is optionally provided adjacent the pocket enabling easy access by the bag user.

14 Claims, 5 Drawing Sheets

MULTI-PURPOSE BAG

BACKGROUND OF THE INVENTION

1. Field of the Invention

The invention disclosed herein relates generally to carrying devices, and more particularly to a bag having an inflatable member integrated therewith such that the bag may be used as both a carrying device and a cushioning device.

2. Description of the Background

Specialty item carrying bags are well known in the art. For example, there are numerous bags previously known which are provided an overall shape corresponding to a particular article intended to be carried by the bag, or which have compartments which are shaped to receive a particular article or a plurality of articles. Likewise, numerous bags have been known which provide multiple compartments for separating products one from another.

Moreover, beach- and pool-goers will often use carrying bags to carry a variety of items they may wish to use while sunbathing, enjoying the water, and the like, such as a swimsuit, towel, snacks and beverages, reading material, etc. However, even with traditional compartmented bags, or bags having a shape corresponding to a specific article, often times it is necessary to place such items in different carrying bags, such as where the person wishes to carry both clothing and canned beverages and does not wish for the clothing to become cold or wet from the beverages, or for the beverages to become warm from being transported in an uninsulated container. Moreover, where the user wishes to take with them a cushion or pillow for increasing their comfort when lounging, their carrying demand increases even further.

It would therefore be advantageous to provide a multi-purpose bag which would allow a user to transport articles within the bag, transport insulated containers in another portion of the bag, and transport a cushion device in yet another portion of the bag.

SUMMARY OF THE INVENTION

It is therefore an object of the instant invention to provide a multi-purpose bag which overcomes the disadvantages of prior art bags.

It is another object of the instant invention to provide a multi-purpose bag having an inflatable member integrated therewith which may be used as a cushion either within the bag or when detached from the bag.

It is yet another object of the instant invention to provide a multi-purpose bag which positions a holder for an insulated beverage container adjacent a cushion for a user's head.

These and other objects are accomplished by providing a multi-purpose bag having a pocket formed on at least one side thereof configured to removably receive an inflatable member. The inflatable member preferably comprises an inflatable balloon held within a fabric sleeve adapted for attachment to a pole, rod, strap, or other elongate member. A drawstring is operatively attached to the pocket to draw the pocket against the inflatable member so as to hinder inadvertent withdrawal of the inflatable member from the pocket. A sleeve is also preferably positioned adjacent the pocket, and is configured to receive an insulated beverage holder. A flexible retaining strap is optionally provided to overlap the sleeve and maintain the beverage holder within the sleeve, even when the bag is transported. Handles are also provided on opposite side edges of the bag, allowing the bag to be carried in a number of varying orientations.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
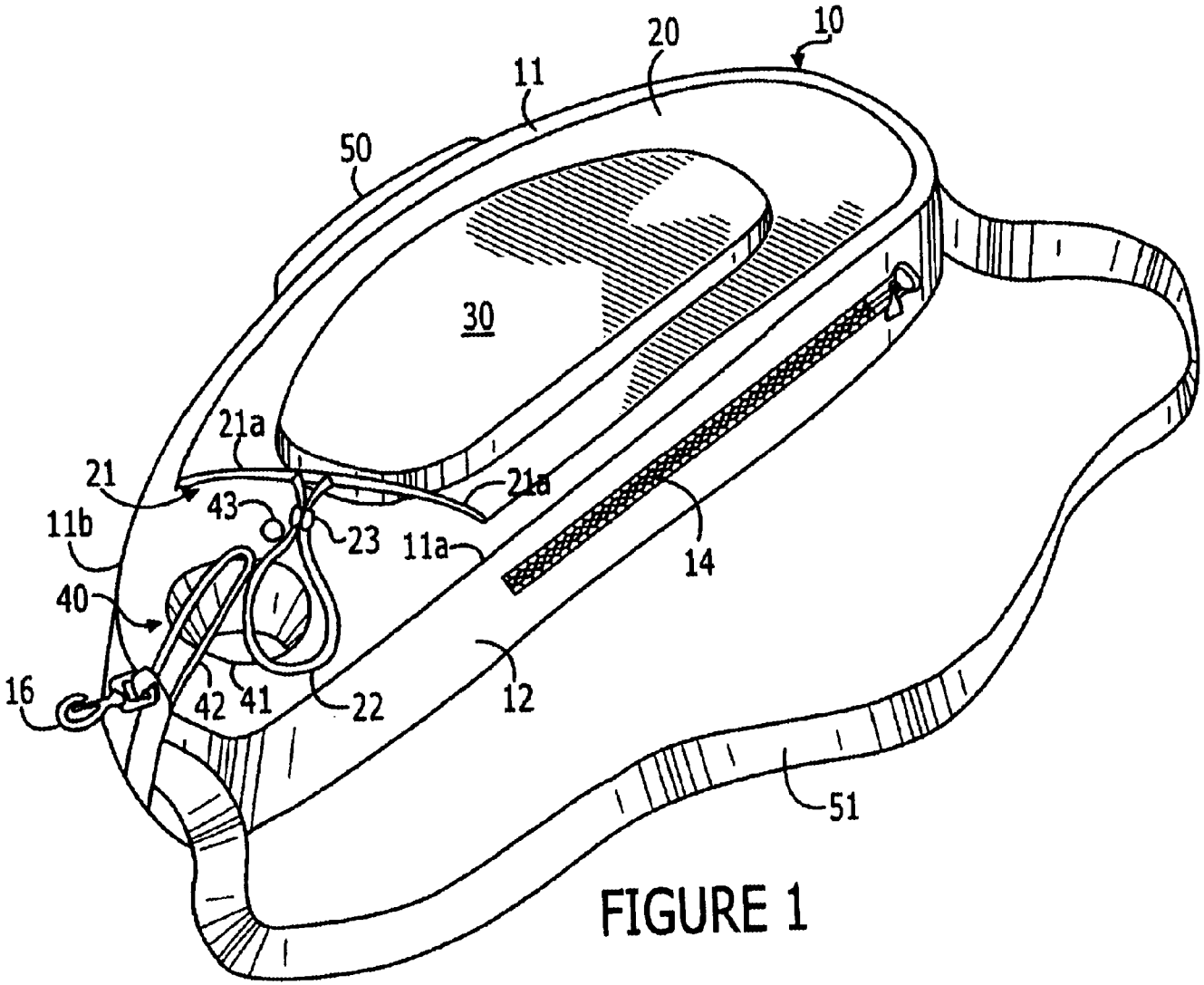
FIG. 1 is a top perspective view of a multi-purpose bag according to a first embodiment of the invention.

As shown in the perspective view of FIG. 1, a first embodiment of the multi-purpose bag of the instant invention comprises a bag body 10 having a generally planar top wall 11, a bottom wall 13 (FIG. 2), and a side wall 12 situated between top wall 11 and bottom wall 13. Both top wall 11 and bottom wall 13 are provided a first generally straight edge 11*a* and a curved edge 11*b* intersecting straight edge 11*a* at either end thereof. Bag body 10 is preferably formed of nylon or some similarly configured, generally flaccid material, and is likewise preferably water-resistant so as to keep dry any items carried within bag body 10. A zipper closure 14 is preferably provided along the straight portion of side wall 12, allowing selective access to an interior storage compartment within bag 10.

In a preferred embodiment of the bag of the instant invention, a handle 50 is provided along the curved section of side wall 12. Handle 50 is preferably comprised of an elongate fabric member securely stitched at either end to side wall 12 in such position as to enable a user to grasp handle 50 and carry bag 10 with the straight edge 11*a* of top face 11 facing downward. Likewise, a shoulder strap 51 is provided, stitched at either end to side wall 12 adjacent the intersections of the straight portion (corresponding to straight edge 11*a* of top face 11) and the curved portion (corresponding to curved edge 11*b* of top face 11) of side wall 12, thus enabling the bag to alternately be carried with the straight edge 11*a* of top face 11 facing upward. Such dual handle application thus provides the combined usefulness and ease of transport of a suitcase or briefcase via handle 50, while maintaining the ability to comfortably carry items from a shoulder suspension via handle 51.

Figure 3:
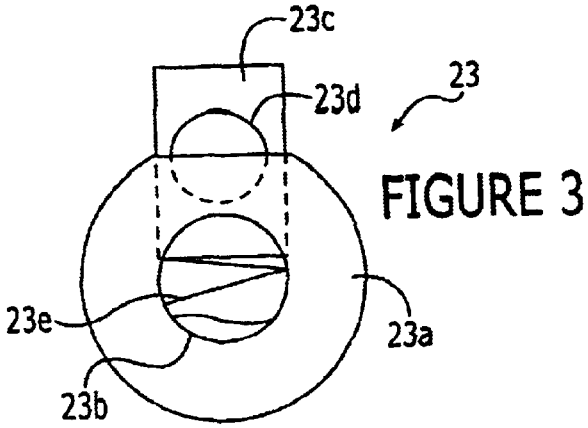
FIG. 3 is a side view of a draw string lock for use with the multi-purpose bag of FIG. 1.

Situated on top wall 11 is a pocket 20 configured for holding an inflatable member 30. Pocket 20 may be formed from the same material as bag body 10 or any similarly configured generally flaccid material. In a preferred embodiment, pocket 20 is formed of a nylon mesh so as to enable items to be carried within pocket 20 while allowing air flow into and out of pocket 20, as may be desired when carrying wet articles which a user may wish to dry. Pocket 20 is preferably stitched to top wall 11 along a major portion of its periphery, leaving an opening 21 at one end thereof A drawstring 22 is preferably provided at opening 21, the free ends of which extend into sleeves 21*a* and are affixed to top face 11 of bag body 10 within sleeves 21*a*. In this way, pulling the end of drawstring 22 results in contraction of opening 21. A simple draw string lock 23 is preferably provided to hold draw string 22, and thus opening 21, in a desired position. Draw string lock may, for example, take the form of a spring biased sliding clamp, as shown more particularly in FIG. 3. Clamp 23 preferably includes an outer body 23*a* having an opening 23*b* extending therethrough, and a plunger 23*c* having an opening 23*d* extending therethrough. Plunger 23*c* is upwardly biased towards the position shown in FIG. 3 via spring member 23*e*, such as a simple coil spring. When plunger 23*c* is depressed into body 23*a* so that openings 23*b* and 23*d* are aligned, clamp 23 may be slid along draw string 22. Likewise, when plunger 23*c* is released, spring member 23*e* upwardly biases plunger 23*c*, in turn clamping assembly 23 against draw string 22 and preventing withdraw of draw string 22 back into sleeve 21.

In a preferred embodiment of a multi-purpose bag of the instant invention, at least one sleeve 40 is provided in the face of top wall 11 forming a cylindrical cavity having a bottom wall 41. Sleeve 40 is preferably sized to receive an insulated drink holder, such as KOOZIE brand foam can coolers as are well known in the art. While sleeve 40 is shown adjacent the drawstring end of pocket 20, it should be noted that sleeve 40 could likewise be positioned at the opposite end of pocket 20, and that multiple sleeves 40 may be provided with at least one on either side of pocket 20, and that such variations are within the scope of the instant invention. However, it should also be noted that placement of one or more sleeves 40 in top face 11 and adjacent either end of pocket 20 is preferred. Such placement allows ease of access to a beverage held within pocket 40 at all times when the bag is in use. For example, when a user places bag 10 on the ground with inflatable member 30 inflated, as would occur when the user wishes to use the bag and inflated member as a pillow, the orientation of sleeve 40 immediately adjacent pocket 20 allows easy access to and storage of a beverage next to the user's head. Likewise, when bag 10 is carried via either of straps 50 or 51, the positioning of sleeve 40 in the side wall allows immediate access to the beverage without interfering with the user's arms.

In order to ensure that the beverage stays in sleeve 40 even when bag 10 is carried by either of handles 50 or 51, a flexible, preferably elastic band 42 affixed at its free ends to bag 10 is provided which extends over sleeve 40. When a canned beverage is situated in an insulated holder and placed within sleeve 40, band 42 may wrap around the top of the can, in turn holding the can in place even when the bag is tilted or turned upside down. To provide even greater assurance that a container will not inadvertently dislodge from sleeve 40, a button or similarly configured fastener 43 is optionally provided adjacent sleeve 40 opposite the point at which band 42 attaches to bag 10, and is positioned to receive and hold the free end of band 42 so that it lies over sleeve 40, in turn clamping the contents of sleeve 40 underneath. Optionally, a clasp 16 may be provided at an end of top face 11 in such position that when drawstring 22 has been pulled so as to contract opening 21, drawstring 22 may also be positioned over sleeve 40 and removably attached to clasp 16, again clamping the contents of sleeve 40 underneath.

Figure 2:
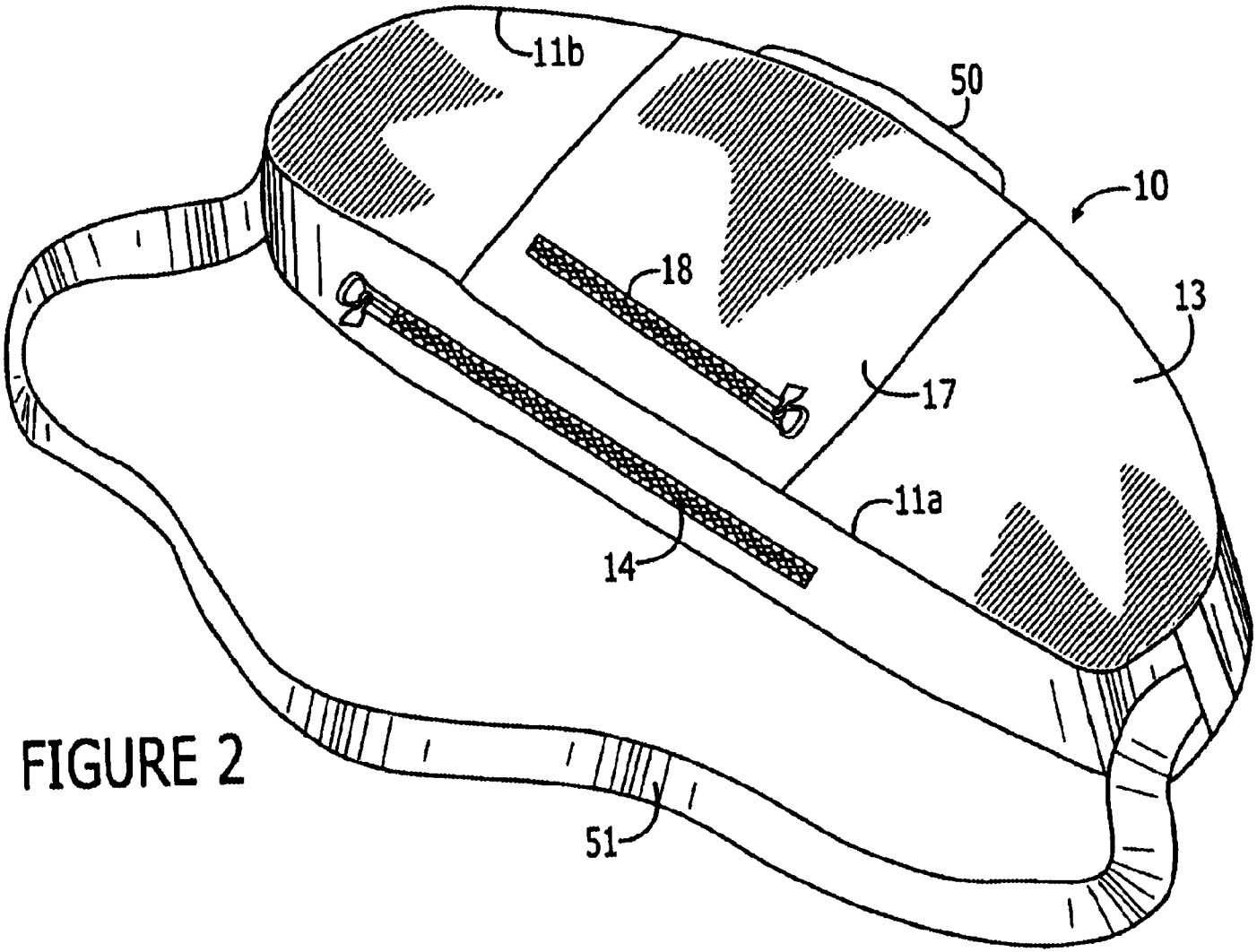
FIG. 2 is a bottom perspective view of the multi-purpose bag of FIG. 1.

As shown in the perspective view of FIG. 2, bottom face 13 is optionally provided a pocket 17 having a zippered opening 18 allowing selective access to pocket 17.

Figure 4:
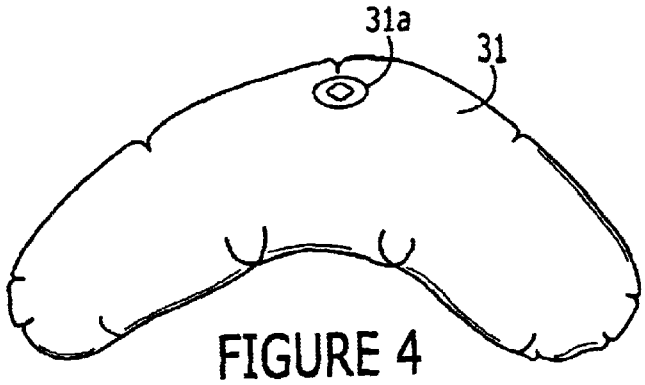
FIG. 4 is a side view of a balloon member for use with the multi-purpose bag of FIG. 1.
Figure 5:
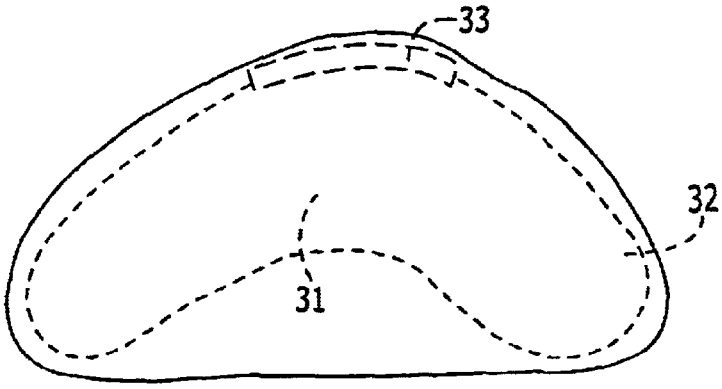
FIG. 5 is a front view of a fabric sleeve for use with the balloon member of FIG. 4.

As mentioned briefly above, an inflatable member 30 is also provided which is of such size that it may be held within pocket 20 in both an inflated and an uninflated state. As shown in FIG. 4, inflatable member 30 comprises a balloon member 31 which is preferably formed in a generally convex oblong shape which, when inflated, may serve as a pillow. A simple pinch valve 31*a* is provided to enable a user to inflate or deflate balloon member 31 as desired. In a preferred embodiment, a fabric sleeve 32 (FIGS. 5 and 6) formed from a soft material, such as terry cloth, and having a shape that is complementary to the shape of balloon member 31, is provided for covering balloon member 31. As shown more particularly in the front view of FIG. 5, fabric sleeve 32 comprises an envelope which is closed along the majority of its perimeter, having an opening situated at the top of sleeve 32 configured to allow insertion of balloon member 31 into fabric sleeve 32. Once balloon member 31 has been inserted, the opening may be held closed by cooperating strips of hook and loop fastening material 33 positioned on the interior of fabric sleeve 32 and surrounding the opening.

Figure 6:
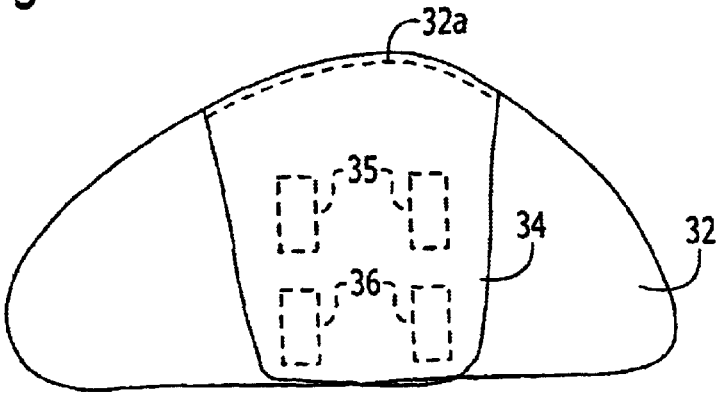
FIG. 6 is a rear view of the fabric sleeve of FIG. 5.
Figure 7:
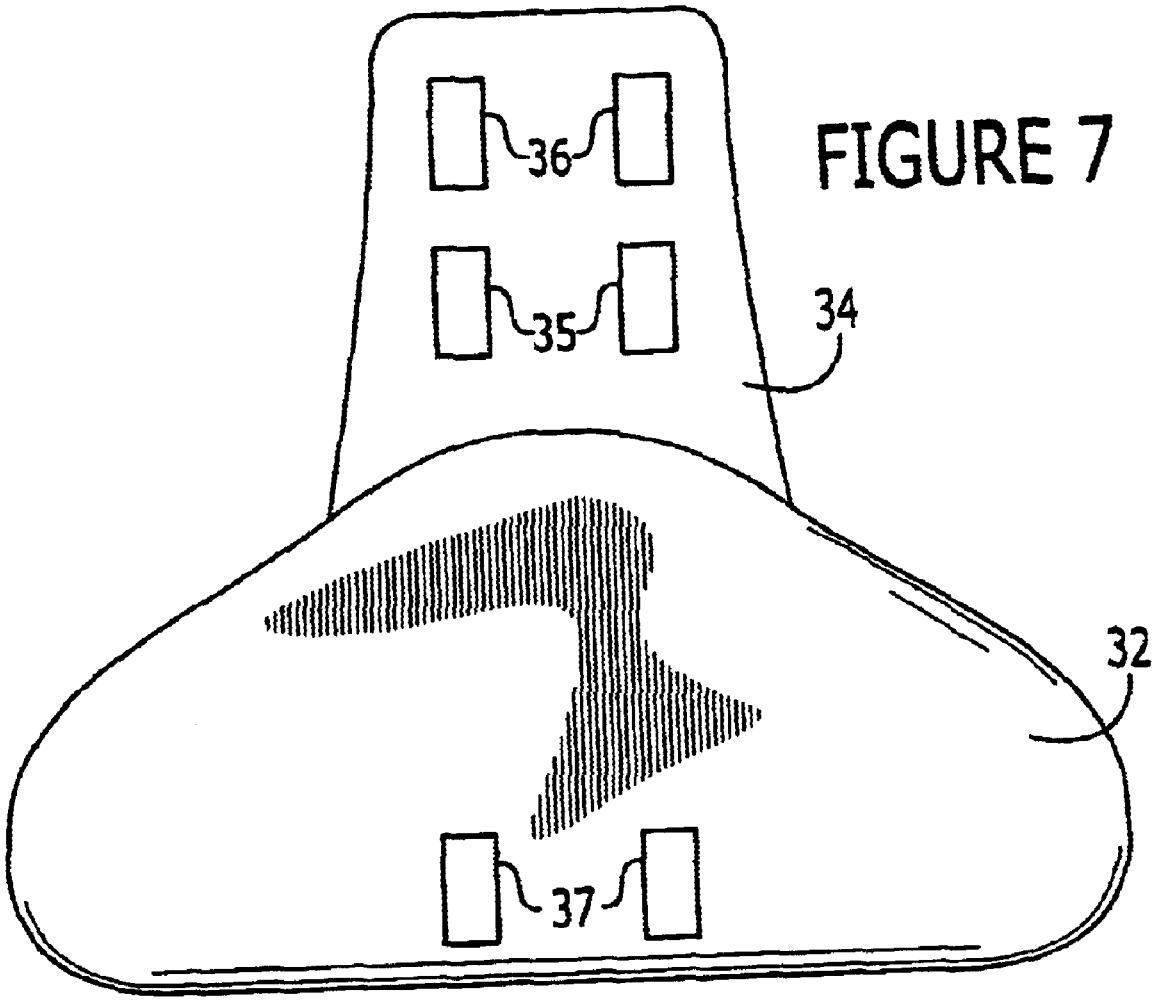
FIG. 7 is a rear view of the fabric sleeve of FIG. 5 with a flap portion extended from the sleeve body.

As shown in the rear view of FIG. 6, fabric sleeve 32 is also preferably provided a flap 34 connected at only its top edge to fabric sleeve 32, such as by stitching 32*a*. Flap 34 is provided on its underside with strips of cooperating hook and loop fastening material 35 and 36. The upper section 35 of hook and loop fastening material is configured to mate with the lower section 36 of hook and loop fastening material. Further, as shown in FIG. 7 where flap 34 is extended away from the back of fabric sleeve 32, additional hook and loop fastening material 37 is provided on the back surface of sleeve 32 which is configured to mate with the lower section 36 of hook and loop fastening material on flap 34. In this way, when flap 34 lies against the back surface of sleeve 32, hook and loop fastening material portions 36 and 37 engage one another to hold the bottom of flap 34 against sleeve 32. Flap 34 may thus be wrapped around an object, such as the top portion of a slotted chair, enabling the entire inflatable member 30 to be removably mounted as a pillow. Likewise, when used with a slotted lounge chair, flap 34 may be inserted through the slats of the chair and wrapped around at least one slat to bring sections 35 and 36 of hook and loop fastening material together with the slat held therebetween, again allowing mounting of inflatable member 30 as a pillow.

While not shown in the Figures, an additional compartment may be provided within pocket 20 in the form of a small pocket or sleeve having a flap closure allowing selective access to the compartment. By positioning such compartment within pocket 20, the compartment is ordinarily situated behind inflatable member 30, such that it is ordinarily hidden from view, providing a desirable location for storing valuables and the like.

Figure 8:
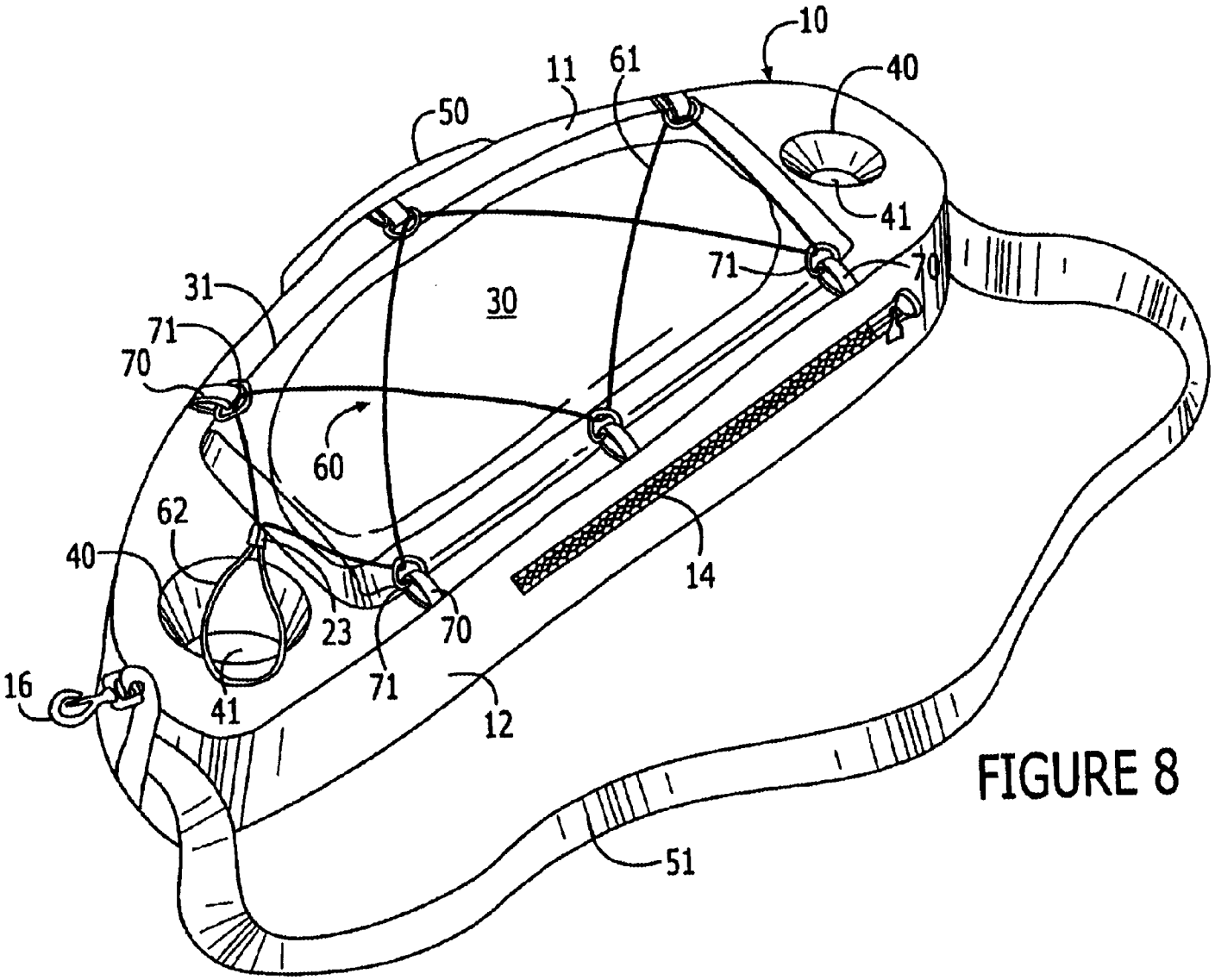
FIG. 8 is a top perspective view of a second embodiment of the multi-purpose bag of the invention.

A first alternate embodiment of bag 10 is shown in the perspective view of FIG. 8, wherein those features that are common to FIG. 1 are depicted by like reference numerals. As shown in FIG. 8, a net (shown generally at 60) formed from an extended length of flexible wire, cable, or cord 61 is provided as a storage compartment for inflatable member 30. Wire, cable, or cord 61 is woven through a series of rings 71 positioned along edges of top wall 11. Rings 71 are preferably formed of metal, rigid plastic, or any other generally rigid material. Each ring 71 is preferably held in place by a loop of fabric 70 stitched at an end to the edge of top wall 11, such that each loop of fabric 70 extends through a ring 71. Alternately, rings 71 may be attached directly to top wall 11, or otherwise affixed to bag 10, or may be replaced altogether with a simple loop of wire, fabric, or any other material capable of holding portions of wire, cable, or cord 61 in the desired configuration. Cable 61 is preferably woven through rings 71 in a criss-cross fashion with its end forming a loop 62, such that loop 62 may serve as a draw string to draw net 61 closely around the contents held therein. A simple draw string lock 23 is again provided on loop 62 to hold the open end of net 61 in a desired position. With loop 62 in the condition shown in FIG. 8, sufficient slack exists in net 60 so as to allow easy insertion of any items to be carried, including inflatable member 30. In the event that inflatable member 30 is intended to be carried by the bag 10 according to this second embodiment, a secondary sleeve 31 is also provided which serves to centrally position inflatable member 30 within net 60.

As with the embodiment shown in FIG. 1, once again a clasp 16 is preferably provided at an end of top face 11 in such position that when loop 62 has been pulled so as to contract net 60, loop 62 may be removably attached to clasp 16 so as to maintain net 60 in a generally constricted position, and again protect any contents of sleeve 40 from dislodging from bag 10. Also, while not shown in FIG. 8, an elastic band 42 (as shown in FIG. 1) may also be provided to clamp the contents of sleeve 40 in place.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. For example, while the Figures depict a pocket 20 on only one side of bag 10, pockets may be provided on both sides of the bag, each of which may take the form of the varying embodiments set forth above. Further, while the Figures depict sleeves 40 situated only on one side of bag 10, such sleeves 40 may also be provided on both sides of bag 10, and in multiple numbers on each side of the bag, without departing from the spirit and scope of the invention. It should be understood, therefore, that the invention may be practiced otherwise than as specifically set forth herein.

We claim:

1. A multi-purpose bag comprising:

a bag body having a hollow interior adapted to carry articles therein, said bag having an opening therein enabling access to said hollow interior;

a pocket affixed to said bag body; and an inflatable member removably held within said pocket, said inflatable member farther comprising a fabric sleeve having an opening therein allowing access to an interior of said sleeve, and an inflatable balloon removably held within said sleeve.

2. The multi-purpose bag of claim 1, said bag body further comprising:

a top wall, a bottom wall, and a side wall extending between said top and bottom walls;

a first handle attached to said side wall and adapted to carry said bag in a first orientation; and a second handle attached to said side wall and adapted to carry said bag in a second orientation opposite said first orientation.

3. The multi-purpose bag of claim 1, said bag further comprising:

a compartment affixed to said bag body within said pocket, said compartment being positioned behind said inflatable member such that said compartment is not visible when said inflatable member is held within said pocket.

4. The multi-purpose bag of claim 1, further comprising:

a sleeve extending into said bag body and positioned adjacent said pocket.

5. The multi-purpose bag of claim 4, wherein said sleeve is particularly configured to receive an insulated foam drink holder.

6. The multi-purpose bag of claim 5, wherein said sleeve defines a generally cylindrical opening extending into a wall of said bag.

7. The multi-purpose bag of claim 4, further comprising:

a flexible strap attached to said bag body at a first position adjacent said sleeve; and a fastener attached to said bag body at a second position adjacent said sleeve which is opposite said first position, said fastener being configured to removably hold said flexible strap over said sleeve.

8. The multi-purpose bag of claim 4, further comprising:

a clasp affixed to said bag body at a first position adjacent said sleeve; and a drawstring operatively attached to said pocket at a second position adjacent said sleeve which is opposite said first position, said drawstring being adapted to constrict said pocket against said inflatable member when said drawstring is pulled away from said pocket;

wherein said clasp is configured to removably hold said drawstring over said sleeve.

9. The multi-purpose bag of claim 1, further comprising:

a drawstring operatively attached to said pocket and adapted to constrict said pocket against said inflatable member when said drawstring is pulled away from said pocket.

10. The multi-purpose bag of claim 1, wherein said pocket is formed from mesh material.

11. The multi-purpose bag of claim 1, wherein said pocket is formed from a loop of cable threaded through a plurality of fasteners affixed to said bag body.

12. The multi-purpose bag of claim 1, said fabric sleeve further comprising a flap hingedly attached to said sleeve and adapted for removable attachment to an elongate member.

13. The multi-purpose bag of claim 12, said flap having at least one first fastener and at least one second fastener configured to mate with said first fastener to removably hold said first fastener to said second fastener, and said fabric sleeve having at least one third fastener configured to mate with said first fastener on said flap to removably hold said first fastener on said flap to said third fastener on said fabric sleeve.

14. The multi-purpose bag of claim 1, where in said pocket is affixed to an outer wall of said bag body.

* * * * *